US005809766A

United States Patent [19]

Stahlecker

[11] Patent Number: 5,809,766

[45] Date of Patent: Sep. 22, 1998

[54] DEVICE FOR CLEANING FIBER MATERIAL IN AN OPEN-END SPINNING AGGREGATE

[76] Inventor: Gerd Stahlecker, Auf der Ebene 30, 73054 Eislingen/Fils, Germany

[21] Appl. No.: 848,672

[22] Filed: Apr. 29, 1997

[30] Foreign Application Priority Data

May 8, 1996 [DE] Germany ..... 196 18 414.2

[51] Int. Cl.[6] ..... D01H 4/00

[52] U.S. Cl. ..... 57/411; 57/301; 57/304; 57/404; 57/408

[58] Field of Search ..... 57/301, 304, 404, 57/407, 408, 411, 412, 413, 414, 415, 417

[56] References Cited

U.S. PATENT DOCUMENTS

| | | | |
|---|---|---|---|
| Re. 30,709 | 8/1981 | Kabele et al. | 57/304 |
| 3,792,575 | 2/1974 | Doublebsky et al. | 57/301 |
| 3,834,145 | 9/1974 | Ellingham et al. | 57/56 |
| 3,892,063 | 7/1975 | Doublebsky et al. | 57/301 |
| 3,922,839 | 12/1975 | Sakurai et al. | 57/301 |
| 4,036,002 | 7/1977 | Kobayaski | 57/304 |
| 4,204,393 | 5/1980 | Miyazaki et al. | 57/301 |
| 4,249,370 | 2/1981 | Vecera et al. | 57/301 |
| 4,495,762 | 1/1985 | Junek et al. | 57/301 |
| 4,852,340 | 8/1989 | Kotrba | 57/301 |

FOREIGN PATENT DOCUMENTS 2018744 4/1971 Germany .

*Primary Examiner*—William Stryjewski
*Attorney, Agent, or Firm*—Evenson McKeown Edwards & Lenahan, PLLC

[57] ABSTRACT

In the case of an open-end spinning aggregate, an opening roller rotates in a housing which comprises a device for cleaning fiber material. A trash removal opening is provided between a sliver feed point and a fiber delivery point in the circumferential wall which surrounds the opening roller, which trash removal opening opens out into the atmosphere. Directly downstream of the trash removal opening, but at a distance upstream of the fiber delivery point, there is a second opening which opens out into the atmosphere and which is purely an air inlet opening. By means of this air inlet opening, the speed of the air flow entering the trash removal opening is reduced, so that even small trash particles, to which fibers may adhere, are removed.

22 Claims, 3 Drawing Sheets

DEVICE FOR CLEANING FIBER MATERIAL IN AN OPEN-END SPINNING AGGREGATE

BACKGROUND AND SUMMARY OF THE INVENTION

This application claims the priority of German application 196 18 414.2 filed in Germany on May 8, 1996, the disclosure of which is expressly incorporated by reference herein.

The present invention relates to a device for cleaning fiber material in an open-end spinning aggregate comprising an opening roller which rotates in a housing which comprises at least two openings which are connected to the atmosphere and are located in a circumferential wall surrounding the opening roller between a sliver feed point and fiber delivery point which is connected to a vacuum source. The first of the openings arranged in the transport direction is a trash removal opening which permits the entry of air, and the second opening arranged in the fiber transport direction is purely an air inlet opening, whereby the air flows entering the two openings are completely separated from one another before entering the housing.

In the case of a device of this type (U.S. Pat. No. 3,892,063), the second opening, provided as an air inlet opening, is applied as an extension extending backwards of a fiber feed channel which begins at the fiber delivery point. Thus the feeding of air in through the trash removal opening is kept to a limit so that even light trash particles can be removed. The large amount of air necessary for the fiber delivery is fed through the separate air inlet opening arranged at the beginning of the fiber feed channel. As the second opening is separated from the trash removal opening by a housing wall, the actual air flow for spinning comes from an area of the spinning aggregate which has no contact with the trash removal opening and which is thus to a great extent free of fly. It has been shown however, that with such an arrangement, the area of the sliver feeding point is subjected to heavy fly accumulation, which is probably a result of the effect of the low pressure generated by the vacuum source not reaching far enough to the sliver feed point.

In the case of a similar device it is further known (German published patent application 20 18 744) that the cleaning point consists of two trash removal openings, which are separated from one another by a part of a housing wall. The same air flow is effective in both openings. While most of the trash particles are discharged from the first trash removal opening, any possible separated fibers are fed by means of the air stream through the second opening back to the spinning process again. This, however, results in light trash particles succeeding in reaching the fiber delivery point, which is admitted in the publication. Furthermore, the spinning vacuum does not have an effect up to the area of the sliver feed point in this device, so that fly accumulation also occurs at the feed area of the fiber material.

It is further known (U.S. Pat. No. 3,834,145) to provide the periphery of the opening roller with bore holes, through which trash particles are carried off into the inside of the opening roller and from there sucked off. Additionally, a further trash removal point in the form of a trash removal opening in the peripheral wall of the housing comprising the opening roller can be provided. Between this trash removal opening and the fiber delivery point a further air inlet opening is applied in case the air entering though the trash removal opening is limited in its amount, which air inlet opening discharges at the front side of the opening roller into the inside thereof. This air, which supports the fiber delivery, has to exit out through the bore holes on the periphery of the opening roller, so that over a longer peripheral area of the opening roller, uncontrolled air flows arise, which interfere with an effective fiber alignment.

Finally, it is known (U.S. Pat. No. 4,249,370) to provide two openings arranged one downstream of the other between a sliver feed point and a fiber delivery point in the peripheral wall which surrounds the opening roller. The first opening serves as a trash removal opening and the second as an air inlet opening. In this case, the trash removal opening is connected directly to a vacuum source, namely in such a way which does not permit the entry of air into the housing of the opening roller. The second opening is thus the only air inlet point, whose effect however does not reach the area of the sliver feed and thus permits fly accumulation at this point.

It is an object of the present invention to ensure in a device of the above mentioned type that the area of the sliver feed point is subjected to significantly less fly accumulation, and that the advantages of a separate air inlet opening, namely the discharging of also fine trash particles covered in fibers, are hereby retained.

This object has been achieved in accordance with the present invention in that the air inlet opening is arranged directly downstream of the trash removal opening and at a good distance upstream of the fiber delivery point.

By means of the air inlet opening located at the above mentioned place, the amount of air and thus the speed thereof which enters through the trash removal opening is so effectively reduced that not only heavy trash particles but also light ones are removed, without the latter being fed back into the spinning process again. The total necessary amount of air is fully retained at the fiber delivery point. Placing the air inlet opening back in the direction of the trash removal opening ensures that the air entering therein must flow along a somewhat longer peripheral area on the opening roller than is known from prior art. This apparently leads to overall more favorable pressure ratios inside the housing of the opening roller, so that, as tests have shown, the fly accumulation at the sliver feed point is significantly less.

For the purpose of the invention, the air inlet opening has a significantly smaller cross section than the trash removal opening. The main amount of air enters as before through the trash removal opening into the housing, but the air amount is reduced however by just so much that the fine trash particles with adhering fibers are not hindered in their removal. The effect of the main air stream entering through the trash removal opening reaches back to the area of the sliver feeding point to such an advantageous degree that, by means thereof the fly accumulation is additionally reduced.

The cross section of the air inlet opening is advantageously alterable. By means thereof, the air entering through the opening can be regulated. A large amount of air entering through the air inlet opening results in the air at the trash removal opening becoming slower. In the case of very dirty cotton, for example, it is practical to open the cross section at the air inlet opening fully. In contrast, when spinning purely synthetic fiber material it is practical to close the air inlet opening to a large extent.

It is advantageous when the air inlet opening is slit-shaped and extends over the entire effective width of the opening roller. By means thereof, the fibers transported by the opening roller are not pushed in transverse direction or condensed, but rather are influenced to the same degree at each point of the effective width.

In certain preferred embodiments of the invention, the air inlet opening is inclined in the fiber transport direction. This leads not only to a favorable air flow, but also to the fact that at the air inlet opening, absolutely no further trash particles can be discharged. The mouth of the air inlet opening into the housing of the opening roller has another direction to the trash removal opening, so that the in-flowing air keeps the air opening clean. Trash particles, which have not been removed and are still adhering to the fibers, can glide past the air inlet opening and thus do not collide against a separation edge.

Further, preferably closable, air inlet openings are provided downstream of the air inlet opening according to certain preferred embodiments of the invention. This is not necessarily achieved by means of a slide valve or other valves, but rather by means of clip-like closing pieces for each air inlet opening, with which as many of the air inlet openings can be closed as required.

The air inlet opening is advantageously shut off from the trash removal opening by a dividing shield or the like according to certain preferred embodiments of the invention. This applies in particular when both air flows, namely the one entering through the trash removal opening and the one entering the air inlet opening are sucked in in the same area of the spinning aggregate.

For the purpose of preferred embodiments of the invention, an air chamber is connected to the air inlet opening, which air chamber is sealed off from the outside atmosphere by means of a sieve or the like. This effects not only a clean air supply, but also permits a light cleaning of the sieve, in particular when the sieve is applied to an easily accessible place.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
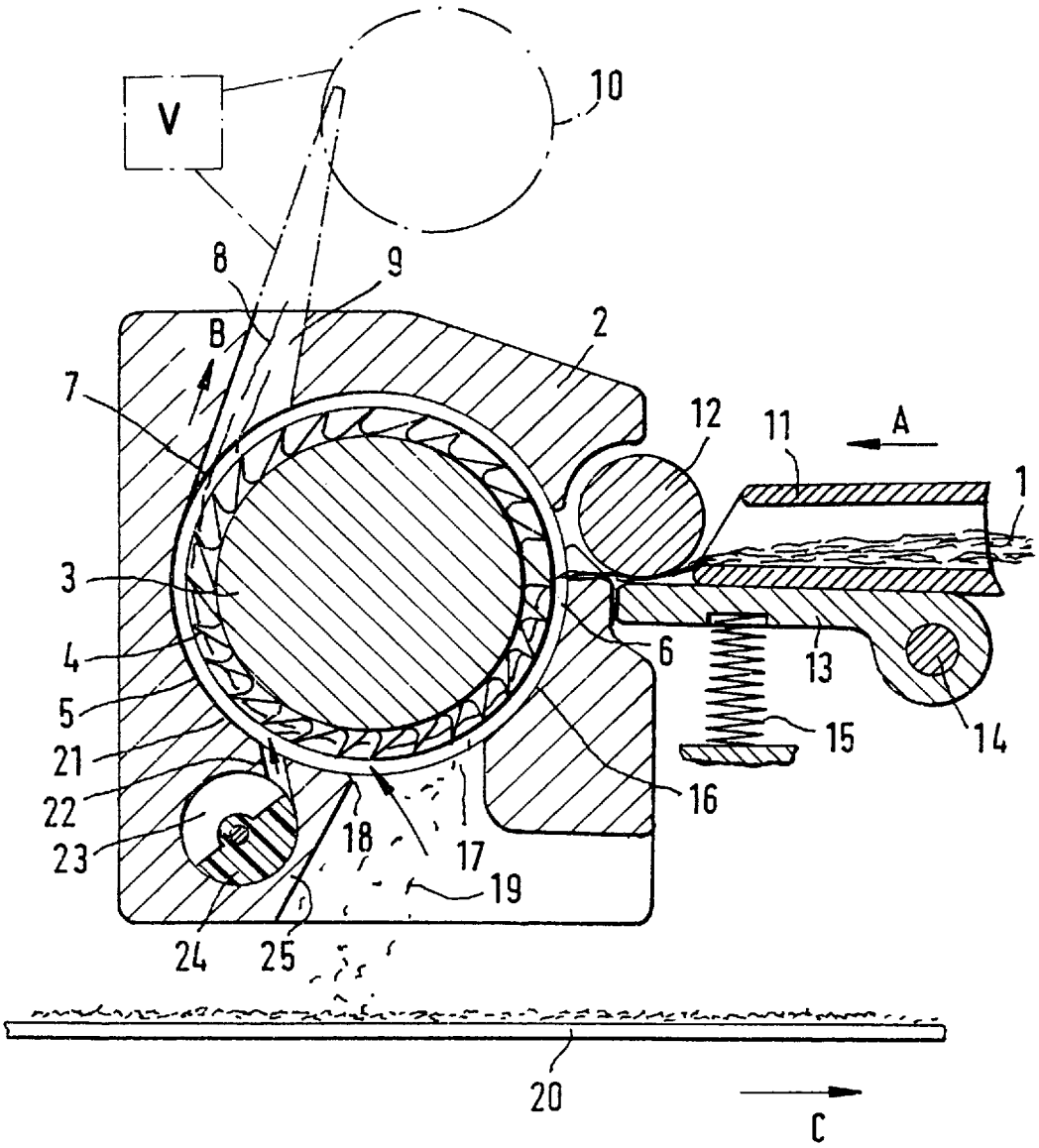
FIG. 1 is a cross-sectional view of a device according to a first preferred embodiment of the present invention comprising a single air inlet opening arranged downstream of the trash removal opening.

In the following description, the devices according to FIGS. 1, 2 and 3 will be described together insofar as they have the same functional components.

The device for cleaning fiber material 1 in an open-end spinning aggregate comprises as an essential component a housing 2, in which an opening roller 3 rotates in a known way. The opening roller 3 is equipped with a saw-tooth or needle-like combing structure 4 and is surrounded by a peripheral wall 5 of the housing 2. The fiber material 1 fed in the form of a sliver reaches a sliver feed point 6 in the housing 2, in which the fiber material 1 is opened to single fibers 8. At a fiber delivery point 7, the fibers 8 are guided out of the housing 2 by means of a fiber feed channel 9 and fed to a spinning rotor 10 which is denoted only by a dot-dash line. The spinning rotor 10 and thus the fiber delivery point 7 are connected to a vacuum source V (schematically depicted in FIG. 1 in dash lines).

The fiber material 1, travelling in feed direction A, reaches a feed roller 12 by means of a feed condenser 11, which presents the fiber material 1 in the known way in the form of a fiber beard to the combing structure 4 of the opening roller 3. A feed table 13 functions in conjunction with the feed roller 12 and together they form a nipping point for the fiber material 1, the feed table 13 being pivotable around a swivel axle 14 under the action of a loading spring 15 and pressed against the feed roller 12.

The area of the fiber beard is pressed into the combing structure 4 of the opening roller 3 by means of a fiber beard support 16 located in the housing 2. The combing effect and production of single fibers 8 is thus improved.

It is of great interest to a spinning mill to remove as much trash as possible from the fiber material 1 to be spun and to dispose of it without any difficulties. When a large amount of trash is removed, the quality of the end product, that is, the spun yarn, is improved. The fabrics produced therefrom are smoother and cleaner. The operation of the open-end spinning aggregate also improves. Trash particles, which reach the spinning rotor 10, cause end breaks or effect a loss in quality with respect to yarn strength and yarn evenness.

For this reason, a known trash removal opening 17 is provided in the housing 2 between the sliver feed point 6 and the fiber delivery point 7, which trash removal opening 17 is connected to the atmosphere. By means of the action of the above mentioned low pressure source, the required air flow (see air arrow) for spinning can enter the housing 2 through the trash removal opening 17. The trash removal opening 17 is bounded in fiber transport direction by a so-called separation edge 18.

The trash removal functions according to the principles of air separation. The trash particles 19 are combed out of the fiber beard by the opening roller 3 and thus brought up to such a high speed that they can leave the area of the opening roller 3 through the trash removal opening 17. The fibers 8 in contrast follow the air flow to the fiber feed channel 9. They remain adhered to the opening roller 3, due, among other reasons, to the effect of the so-called air limiting layer. The cleaned fibers 8 are guided along a fiber guiding surface 21 arranged downstream of the trash removal opening 17, and leave the area of the combing structure 4 at the fiber delivery point 7 in arrow direction B through the fiber feed channel 9. The trash particles 19 on the other hand fall onto a trash transport belt 20, which travels in transport direction C past a plurality of open-end spinning aggregates at a distance below the trash removal opening 17.

The removal of trash particles 19 can be improved when the air flow entering the housing 2 through the trash removal opening 17 is reduced, as then also relatively small trash particles 19 are able to reach the trash transport belt 20 despite the air flow, and are not sucked back into the housing 2. The air flow cannot be just so reduced by a reduction in pressure of the vacuum source, as a minimum amount of air is required for delivering the fibers 8 from the fiber delivery point 7 to the spinning rotor 10. The air speed at the fiber delivery point 7 should be high. The fibers 8 should also be accelerated in the fiber feed channel 9 towards the spinning rotor 10, so that a high air speed is also necessary here. Experience has shown that the open-end spinning aggregate spins better the more air flows through the fiber feed channel 9.

In order that this is possible without increasing the low pressure of the vacuum source, an air inlet opening 22 is provided immediately downstream of the separation edge 18, which air inlet opening 22 is connected to the atmosphere. This air inlet opening 22 is inclined in the fiber transport direction so that no trash particles 19, which could accumulate as fly in the air flow entering through the air inlet opening 22, can be removed through it. The air inlet opening 22 should be as far away from the fiber delivery point 7 as possible and located directly downstream of the trash removal opening 17, so that by effect of injection a low pressure acts as far back to the area of the sliver feed point 6 as possible. Thus it is effectively avoided that in the area of the sliver feed point 6 and in particular in the area of the nipping point between the feed roller 12 and the feed table 13, fly accumulation collects in unacceptable amounts.

According to FIG. 1, the air inlet opening 22 is connected to an air chamber 23. A turnable filler piece 24 made of plastic is applied in the air chamber 23. When this filler piece 24 is turned in an anti-clockwise direction, the air inlet opening 22 is closed, and the open-end spinning aggregate functions as though practically the entire amount of spinning air enters through the trash removal opening 17 into the housing 2. When, however, the air inlet opening 22 is opened, either to a greater or to a lesser degree, this gives rise to an additional air stream corresponding to the arrow direction, which air stream is however smaller than the air stream entering through the trash removal opening 17.

In FIG. 1, the filler piece 24 partly closes the air inlet opening 22, so that the air flow entering therein is not yet at a maximum. However, the air flow entering through the trash removal opening 17 is already reduced, so that more small trash particles 19 are removed. The small trash particles with adhering short fibers are able to overcome the distance to the take-up surface of the trash transport belt 20 by means of the kinetic energy they received. The danger of the trash particles 19 which are laid down on the transport belt 20 being sucked back up is significantly reduced.

The air opening 22 extends over the width of the opening roller 3, and at least over the width of the combing structure 4. It is hereby important that the air flow entering through the air inlet opening 22 comes from an area of the open-end spinning aggregate which is as free from fly accumulation as possible and which has absolutely no contact with the air flow of the trash removal opening 17 or with the trash transport belt 20. For the purpose of the present invention, the air flow entering through the air inlet opening 22 should flow frontally into the open-end spinning aggregate. This air flow can be separated off from the trash particles 19 by a separator shield 25 or such like.

The cross section of the air inlet opening 22 is of such dimensions that the air flow entering through the trash removal opening 17 is larger than the air flow entering through the air inlet opening 22. As already mentioned, care must hereby be taken that no trash particles 19 are removed through the air inlet opening 22. This would result in blockages, or at least make the cleaning of the open-end spinning aggregate difficult.

Thus in accordance thereto, it is advantageous in the case of the air inlet opening 22 to avoid all trash separation edges, in that the air inlet opening 22 has a more or less tangential direction in relation to the rotational direction of the opening roller 3. The in-coming air then keeps the air inlet opening 22 clean, and trash particles 19 not removed in the area of the trash removal opening 17 can glide past the air inlet opening 22 without colliding with a separation edge. In order to ensure that it does not become dirty, a travelling aggregate can at intervals blow out the air inlet opening 22. The air chamber 23 can be provided with a valve for this purpose, to which the travelling aggregate is connected. Cleaning by a travelling aggregate can for the purpose of the invention be carried out in conjunction with a piecing process on the relevant open-end spinning aggregate.

Figure 2:
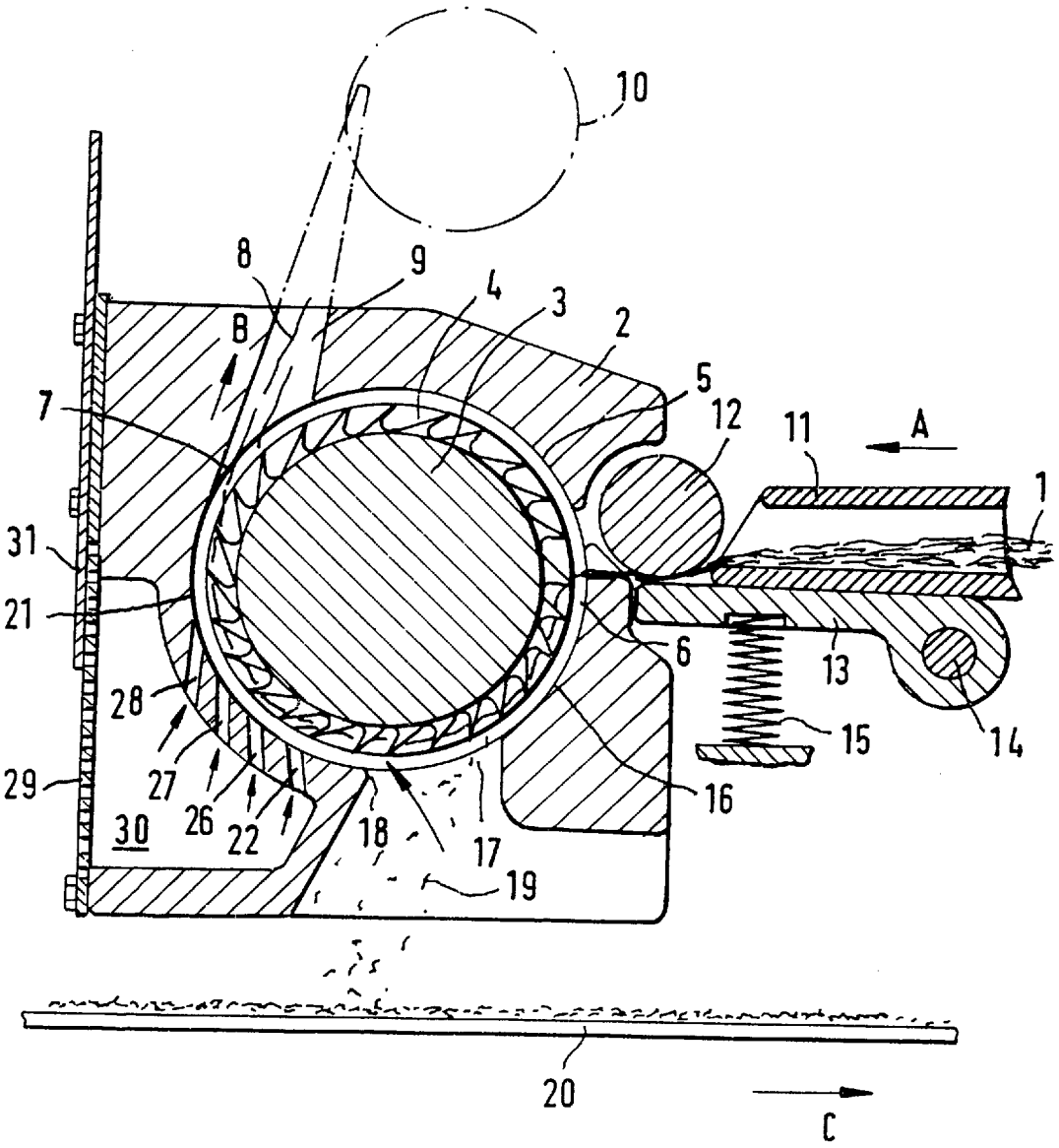
FIG. 2 is a view similar to FIG. 1 showing another preferred embodiment of the present invention, in which further air inlet openings are arranged downstream of the air inlet opening.

In the embodiment in FIG. 2, three further air inlet openings 26,27,28 are arranged downstream of the air inlet opening 22 arranged downstream of the separation edge 18 of the trash removal opening 17. These additional air inlet openings 26,27,28 are also arranged in the fiber transport direction. Each individual slit-shaped air inlet opening 22,26,27 or 28 can be provided either with a pivotal valve or a sliding valve, so that the amount of air can be regulated at every entry point. It is also contemplated according to certain preferred embodiments that personnel are provided with clip-on tappets, so that, according to requirements, individual air inlet openings 22,26,27 or 28 can be selectively closed. The open-end spinning aggregate can thus be adapted to the fiber material 1 to be spun.

It must be presumed that the air in a spinning mill is never quite clean, and thus there is the risk that, despite all precautionary measures, fly accumulates in the vicinity of the air inlet openings 22,26,27 or 28, in particular where dirty cotton is processed. The air inlet openings 22,26,27 and 28 themselves remain certainly free of fly, due namely to the air stream, which also has a cleaning effect. However, beside the air inlet openings 22,26,27 and 28, where the air conditions are not so clear-cut, fly can form. In order to avoid this, the air chamber 30, from which the air inlet openings 22,26,27 and 28 come, is closed by a sieve 29 in the form of a fine-mesh grating. Instead of this grating, a thin sheet metal comprising a closely packed perforation can be used. Ideal would be a plate of sinter material, as used for air bearings. This would totally ensure that no trash could enter the air chamber 30. It is then a simple matter for a travelling maintenance device to clean the surface of the sieve 29 at regular intervals.

As can be seen from FIG. 2, a slide valve 31 is provided in the form of a sheet metal plate, and with which slide valve 31 the grating-like sieve 29 is partly closed. It is thus possible to determine the entire volume of the air supply. The more air that flows through the air inlet openings 22,26,27 and 28, the less risk there is that the trash particles 19 combed out in the area of the fiber beard are sucked back into the spinning rotor 10 after a detour through the trash removal opening 17.

Figure 3:
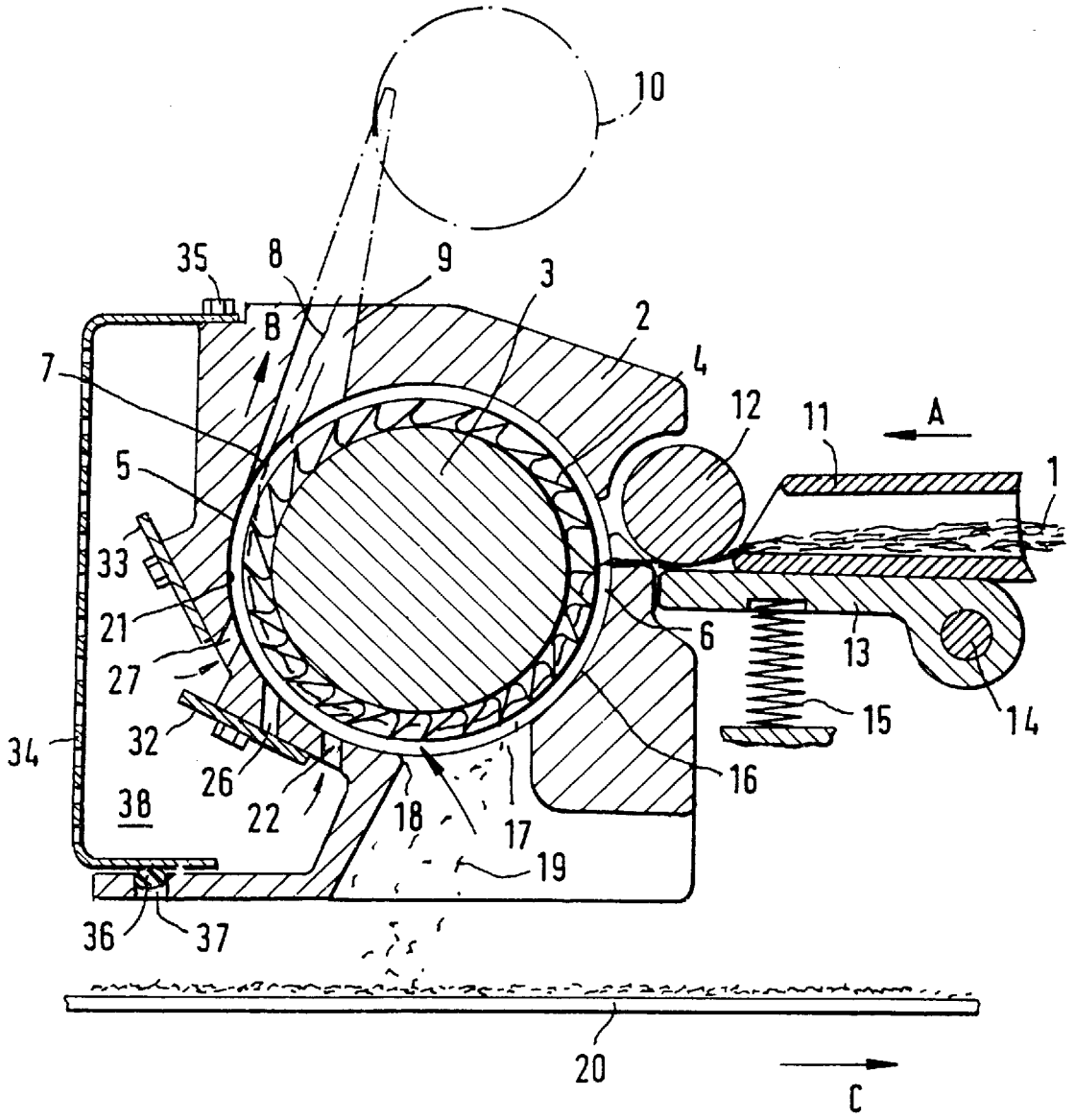
FIG. 3 is a view similar to FIG. 2 showing another preferred embodiment of the invention, whereby the cross section of each individual air inlet opening is adjustable.

The variation in FIG. 3 shows an embodiment in which again three air inlet openings 22,26, and 27 are present at the periphery of the opening roller 3. The air inlet opening 26 is covered by a slide valve 32, while a slide valve 33 is pulled upwards and fixed, so that the air inlet opening 27 located downstream remains open. The first air inlet opening 22 can also be closed with the slide valve 33.

Again in this case, the air chamber 38 arranged to the air inlet openings 22,26 and 27 is also covered by a grating-like sieve 34, whereby it is assumed that a fly layer will form on the gratinglike sieve 34, which is removed automatically at regular intervals by a maintenance device. It is hereby practical to construct the open-end spinning aggregate so that unavoidable fly settles on a quite specific, easily accessible point. The sieve 34 has a plane surface, and to free it from a fly layer presents no technical difficulties. By loosening a screw 35, the sieve 34 can be removed. The sieve 34 comprises two bolt-like fixing elements 36 underneath, which engage in the corresponding holes 37 of the wall of the housing 2.

In this embodiment it is also an aim to slow down the air flow entering through the trash removal opening 17, at least to slow it to such a point that, due to the lower pressure difference, the fibers 8 in the combing structure 4 of the opening roller 3 remain secure, while the trash particles 19 combed out in the area of the fiber beard support 16 are ejected out of the fiber material 1 as a result of the kinetic energy they receive, and reach the trash removal belt 20 safely. The danger that the air flow entering through the trash removal opening 17 could send the trash particles 19, as soon as they become slower, back into the housing 2, no longer exists.

It is the task of the spinning mills to establish by means of tests what volume of air should pass through the air inlet openings 22,26 or 27. This setting is dependent, among other things, on the speed of the opening roller 3 and on the acceleration of the fibers 8 by the combing structure 4.

The devices described above are concerned primarily not with the larger trash particles 19, but rather with the smaller neps and small particles to which fibers adhere, which unfavorably change the entire surface in relation to their weight. By means of the present invention, it is possible to remove the small trash particles 19 and to make the spun yarn cleaner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A fiber supply arrangement for an open-end spinning aggregate, comprising:

an opening roller, a housing surrounding said opening roller, a sliver feed opening in said housing, a trash removal opening disposed downstream of said sliver feed opening with respect to sliver fiber travel, an air inlet opening disposed downstream of said trash removal opening with respect to sliver fiber travel, a fiber feed channel beginning at an opening disposed downstream of said air inlet opening with respect to sliver fiber travel, and suction apparatus creating underpressure at an end of said fiber feed channel for sucking an air stream through said fiber feed channel, the air of said air stream being sucked in at said sliver feed opening, at said trash removal opening, and at said air inlet opening, wherein said air inlet opening is disposed adjacent said trash removal opening and has a significantly smaller cross section than the cross section of said trash removal opening so that a majority of air forming said air stream is sucked in through said trash removal opening.

2. A fiber supply arrangement according to claim 1, wherein the cross section of the air inlet opening is adjustable.

3. A fiber supply arrangement according to claim 2, wherein the air inlet opening is separated from the trash removal opening by means of a separating shield.

4. A fiber supply arrangement according to claim 2, wherein an air chamber is connected to the air inlet opening, which air chamber is closed to the atmosphere by means of a sieve.

5. A fiber supply arrangement according to claim 1, wherein the air inlet opening is slit-shaped and extends over the entire effective width of the opening roller.

6. A fiber supply arrangement according to claim 5, wherein the cross section of the air inlet opening is adjustable.

7. A fiber supply arrangement according to claim 5, wherein an air chamber is connected to the air inlet opening, which air chamber is closed to the atmosphere by means of a sieve.

8. A fiber supply arrangement according to claim 1, wherein the air inlet opening is inclined in a fiber transport direction.

9. A fiber supply arrangement according to claim 8, wherein the air inlet opening is slit-shaped and extends over the entire effective width of the opening roller.

10. A fiber supply arrangement according to claim 1, wherein further selectively closable air inlet openings are arranged downstream of the air inlet opening.

11. A fiber supply arrangement according to claim 10, wherein the air inlet opening is slit-shaped and extends over the entire effective width of the opening roller.

12. A fiber supply arrangement according to claim 1, wherein the air inlet opening is separated from the trash removal opening by means of a separating shield.

13. A fiber supply arrangement according to claim 12, wherein the air inlet opening is inclined in a fiber transport direction.

14. A fiber supply arrangement according to claim 1, wherein an air chamber is connected to the air inlet opening, which air chamber is closed to the atmosphere by means of a sieve.

15. A fiber supply arrangement according to claim 14, wherein the air inlet opening is inclined in a fiber transport direction.

16. A fiber supply arrangement according to claim 15, wherein further selectively closable air inlet openings are arranged downstream of the air inlet opening.

17. A fiber supply arrangement according to claim 16, wherein the air inlet opening is separated from the trash removal opening by means of a separating shield.

18. A fiber supply arrangement according to claim 14, wherein further selectively closable air inlet openings are arranged downstream of the air inlet opening.

19. A fiber supply arrangement according to claim 1, wherein the at least one air inlet opening is spaced circumferentially around the opening roller circumference from the trash removal opening by a substantially smaller distance than it is spaced from the fiber feed opening.

20. A fiber supply arrangement according to claim 19, wherein the air inlet opening has a significantly smaller cross section than the trash removal opening.

21. A fiber supply arrangement according to claim 20, wherein the cross section of the air inlet opening is adjustable.

22. A fiber supply arrangement according to claim 20, wherein the air inlet opening is slit-shaped and extends over the entire effective width of the opening roller.

* * * * *